United States Patent [19]

Swinbanks

[11] Patent Number: 4,589,133

[45] Date of Patent: May 13, 1986

[54] ATTENUATION OF SOUND WAVES

[75] Inventor: Malcolm A. Swinbanks, Pentlands Close, England

[73] Assignee: National Research Development Corp., London, England

[21] Appl. No.: 620,751

[22] Filed: Jun. 14, 1984

[30] Foreign Application Priority Data

Jun. 23, 1983 [GB] United Kingdom ..... 8317086

[51] Int. Cl.[4] ..... F01N 1/06

[52] U.S. Cl. ..... 381/71

[58] Field of Search ..... 381/71, 56, 94

[56] References Cited

U.S. PATENT DOCUMENTS

| | | | |
|---|---|---|---|
| 4,044,203 | 8/1977 | Swinbanks | 381/71 |
| 4,449,235 | 5/1984 | Swigert | 381/71 |
| 4,455,675 | 6/1984 | Bose et al. | 381/71 X |
| 4,480,333 | 10/1984 | Ross | 381/94 X |

FOREIGN PATENT DOCUMENTS 1548362 1/1975 United Kingdom .

*Primary Examiner*—James L. Dwyer

*Attorney, Agent, or Firm*—Cushman, Darby & Cushman

[57] ABSTRACT

An active sound control system is described in which allowance is made in a relatively uncomplicated circuit for acoustic coupling between a sound generating system for generating a cancelling sound wave and a detector for sensing a sound wave to be cancelled. Unwanted sound from a source is detected by a microphone and cancelled by sound from a speaker connected by way of an amplifier to the microphone. The amplifier has a feedback processing system with a transfer function which takes account of acoustic feedback between the speaker and the microphone in deriving, with the amplifier, a signal to drive the speaker.

11 Claims, 6 Drawing Figures

ATTENUATION OF SOUND WAVES

This invention relates to the attenuation of sound waves by means of active sound control techniques.

The invention is concerned in particular with active sound control systems of the kind comprising a sound detection system arranged to be responsive to an unwanted sound wave which it is desired to attenuate, a sound generating system, and control means for operating the generating system in response to a signal derived from the detection system so as to generate a cancelling sound wave which will interfere destructively with the unwanted wave in a selected spatial region. It is normally required to design such a system so that substantial attenuation will be achieved over a range of frequencies, and it is then of course necessary for the generation of the cancelling sound wave to be controlled in respect of both amplitude and phase at any particular frequency within that range; it is also usually desirable to reduce to a minimum the possibility of excitation of the generating system at frequencies outside the relevant range. It is therefore normally appropriate for the control means to incorporate a signal processing system via which the signal derived from the detection system is fed to the generating system and which operates differentially on components of different frequencies in that signal; to achieve optimum performance for a given installation, such a signal processing system is required to have a complex transfer function whose precise form will depend on factors such as the nature of the source of the unwanted wave, the constitution of the sound generating system, the form of the acoustic paths involved, and the characteristics of the transducers (e.g. microphones and loudspeakers) respectively used in the sound detection and generating systems.

A major consideration in the design of sound control systems of the kind specified is the possible occurrence of acoustic coupling between the sound generating and detection systems. In some cases it may be possible effectively to avoid any such coupling by using an appropriately directional array of transducers in one or both of the generating and detection systems, for example as disclosed in British Patent Specification No. 1,456,018 and a paper by the inventor published in Journal of Sound and Vibration, Vol. 27 (1973), pages 411–436. In other cases it may be possible deliberately to take advantage of such acoustic coupling in the design of the sound control systen, for example as disclosed in British Patent Specification No. 1,548,362. There are, however, situations in which it is inappropriate or inexpedient to adopt either of these approaches, and consideration may then be given to the possiblity of incorporating in the sound control system an arrangement which has the effect of removing from the signal derived from the detection system any contribution attributable to acoustic coupling between the generating and detection systems.

The present invention offers a particularly simple way of realising this possibility while meeting the normal requirements for the design of an active sound control system of the kind specified.

According to the invention there is provided an active sound control system of the kind specified in which there is acoustic coupling between the sound generating system and the sound detection system, and in which the control means incorporates a signal processing system via which the signal derived from the detection system is fed to the generating system, the signal processing system comprising a forward signal-translating component having a gain factor which is of constant value G at least over a given frequency range and a negative feedback loop having a transfer function substantially of the form $(D_s+1/F-1/G)$, where $D_s$ represents the transfer function from the output to the input of the signal processing system via said acoustic coupling, and F represents the transfer function of a notional band-pass filter whose pass band corresponds to said frequency range, the filter having characteristics such that if said acoustic coupling did not exist it would be appropriate to use the filter in place of the actual signal processing system in order to achieve substantial attenuation in said selected region of any components of the unwanted sound wave having frequencies within said range.

The invention will be further described and explained with reference to the accompanying drawings, in which.

Figure 1:
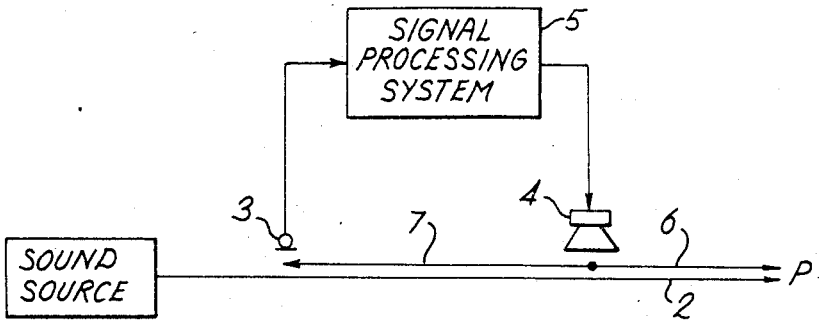
Fig. 1 PRIOR ART
FIGS. 1 to 3 are diagrams illustrating the principles of certain active sound control systems of the kind specified.

FIG. 1 illustrates diagrammatically a situation (treated for simplicity on a one-dimensional basis) in which it is desired to attenuate at a point P a sound wave emanating from a source 1 and indicated by the arrow 2. For this purpose there is provided an active sound control system including a detection system indicated by the microphone 3 and a generating system indicated by the loudspeaker 4. The detection system 3 is arranged to be responsive to the wave 2 and its output is fed via a signal processing system 5 to the generating system 4 so as to generate a cancelling sound wave indicated by the arrow 6. It is assumed that the system 3 is also responsive to sound generated by the system 4, the acoustic coupling between these systems being represented by the arrow 7. It is further assumed that it is required to design the control system so as to achieve at the point P effective cancellation of those components of the wave 2 having frequencies within a given range.

Complete cancellation at P of a component of given frequency in the wave 2 of course requires that the wave 6 should have a component of the same frequency such that at P the two components will have the same amplitude but be of opposite phases. This condition may be expressed by the equation $$NP_n+SP_s=0 \qquad (1)$$

where N, S, $P_n$ and $P_s$ respectively represent the values at the relevant frequency of the output of the source 1, the output of the system 5, the transfer function from the source 1 to the point P, and the transfer function from the output of the system 5 to the point P. Since both amplitude and phase characteristics are relevant these values will in general be complex numbers (which are of course liable to vary with frequency). Now S is given by the equation $$S=T(ND_n+SD_s) \qquad (2)$$

where T, $D_n$ and $D_s$ respectively represent the values at the relevant frequency of the transfer function of the system 5, the transfer function from the source 1 to the input of the system 5 and the transfer function from the output to the input of the system 5 via the acoustic coupling between the systems 4 and 3. By rearranging equation (2) and substituting for S in equation (1), it can readily be deduced that equation (1) will be satisfied if, and only if, one satisfies the equation $$T=(D_s-P_sD_n/P_n)^{-1} \quad (3)$$

Accordingly, in designing the control system a primary objective will be to ensure that over the given frequency range T approximates closely to the ideal value given by equation (3). This of course requires a knowledge of the way in which the parameters on the right hand side of this equation vary with frequency, which can readily be obtained from preliminary experiments involving analysis of signals derived respectively from the detection system 3 and a further sound detection system (not shown) located at P; for example information regarding $D_s$ and $P_s$ can be obtained from experiments carried out with the system 4 excited by means of a suitable noise signal (the system 5 of course not being present) and information regarding the ratio $(D_n/P_n)$ can be obtained from experiments carried out with the source 1 operative but the system 4 inoperative. The subsequent implementation of the system 5 so as to achieve within the given frequency range an appropriate approximation to the ideal form of the transfer function given by equation (3) may be effected in various known ways, but it will commonly be convenient to utilise digital signal processing techniques for this purpose. The possible accuracy of the approximation will depend on a number of factors, a significant consideration being that although the transfer functions whose values are represented by $D_s$, $D_n$, $P_s$ and $P_n$ are stable and realisable it is by no means certain that the same will be the case for the inverse function represented by the expression on the right hand side of equation (3).

While meeting the objective discussed in the preceding paragraph, it is important to ensure that the operation of the control system does not give rise to a significant risk of enhancement of the sound level at P in respect of components having frequencies outside the given range. It is therefore appropriate to arrange for the system 5 to exhibit the characteristics of a band-pass filter having a pass band corresponding to that frequency range.

It will be appreciated that if the acoustic coupling between the systems 4 and 3 did not exist the analysis set out above would be modified by replacing equation (2) with the equation $$S=TND_n \quad (4)$$

and that accordingly the condition for equation (1) to be satisfied would be represented simply by the equation $$T=-P_n/D_nP_s \quad (5)$$

Figure 2:
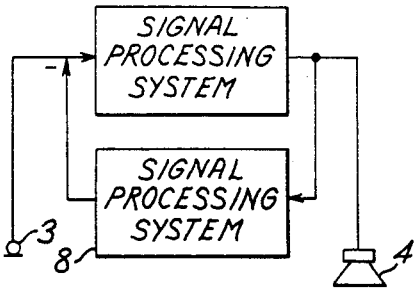
Fig. 2 PRIOR ART

The acoustic coupling between the systems 4 and 3 can in practice be effectively nullified by adopting the modified form of control system illustrated in FIG. 2, in which there is added a negative feedback loop incorporating a second signal processing system 8 designed so that the value of its transfer function at a given frequency closely approximates to $D_s$. The effect of this is of course to subtract from the output of the system 3 that contribution attributable to the acoustic coupling between the systems 4 and 3. The problem of designing the system 5 can then be dealt with on an "open loop" basis, using equation (5) instead of equation (3). In particular, there is no need to impose any stability constraints on the rate of "roll-off" of the band-pass filter characteristics.

Figure 3:
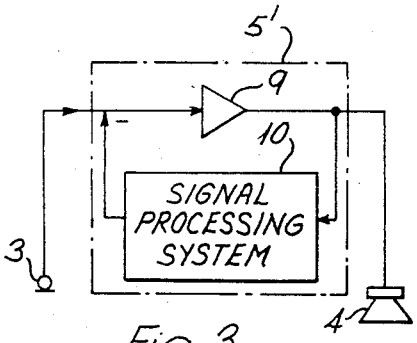

The present invention is based on the realisation that it is possible to provide an equivalent to the arrangement shown in FIG. 2 which is simpler to implement in practice since it requires the synthesis of only one transfer function and not two. A significant consideration in this respect is the assumption that a stringent filtering requirement exists, which implies that the transfer function appropriate for the system 5 in the FIG. 2 arrangement will have a realizable inverse function which is also stable. The principle involved is illustrated in FIG. 3, in which the system 5 of the FIG. 1 arrangement is replaced by a signal processing system generally designated 5', this system comprising a forward signal-translating component 9 and a negative feedback loop incorporating a signal processing system 10. If the component 9 has a gain factor which is of constant value G over the given frequency range, it follows from conventional feedback theory that for any given frequency in that range $$T'=(T_f+1/G) \quad (6)$$

where T' and $T_f$ respectively represent the values at the relevant frequency of the transfer functions of the systems 5' and 10. From the discussion above, it will be appreciated that one wishes to arrange for T' to approximate closely to the value given by equation (3), and by comparing that equation with equation (6) it will be seen that this objective will be achieved if $T_f$ approximates closely to $(D_s-P_sD_n/P_n-1/G)$. The ideal form of $T_f$ can thus be expressed as $(D_s+1/T_o-1/G)$ if one denotes by $T_o$ the ideal value of T which would be given by equation (5) for the FIG. 1 arrangement if the acoustic coupling between the systems 4 and 3 did not exist.

The foregoing discussion deals with a situation in which consideration is given only to the effect of the active sound control system at a single point P. Such a simplified treatment may be sufficient in dealing with certain applications of active sound control systems, for example in connection with the attenuation of a sound wave propagating along a duct. In other possible applications of active sound control systems, however, the problem is of a two-dimensional (or even three-dimensional) character, and practical limitations on the form of the sound generating system may then preclude the possibility of arranging matters so that equation (1) is satisfied simultaneously for all points in the region in which attenuation is required. In such a case, while it would be possible to arrange for $T_f$ to be determined in accordance with the expression $(D_s+1/T_o-1/G)$ taking $T_o$ as ascertained in respect of a single point in the relevant region, this would not in general result in optimum performance in respect of attenuation when considering the relevant region as a whole. Instead, it will normally be preferable to replace $T_o$ in the expression for the ideal form of $T_f$ by a mean value $\overline{T}$ determined in accordance with observations made in respect of a series of points appropriately distributed in the relevant region; denoting these points by $P_1$, $P_2$, etc., a suitable formula for determining $\overline{T}$ is given by the equation $$\overline{T}=(\Sigma 1/T_r^*)/(\Sigma 1/T_rT_r^*) \quad (7)$$

where $T_r$ denotes the value of $(-P_n/D_nP_s)$ in respect of the point $P_r$, $T_r^*$ denotes the complex conjugate of $T_r$, and the summations are each taken over the whole series of points.

The value of $\overline{T}$ given by equation 7 represents the condition in which the average attenuation is maximised but a more general expression is $$\overline{T} = \Sigma \frac{W_r}{T_r^*} / \Sigma \frac{W_r}{T_rT_r^*}$$

where $W_r$ is a weighting given to the $r^{th}$ point in order to achieve some desired result and may be a function of a variable. for example frequency. Where some points are relatively quiet the values $W_r$ may for example be chosen to obtain a more uniform low sound pressure level. Alternatively $\overline{T}$ may be replaced by other functions of $T_r$ which meet particular requirements.

One embodiment of the invention will now be described by way of example, with reference to an active sound control system designed to attenuate sound emanating from the exhaust of a static gas turbine installation. The specific requirement in this case was to achieve substantial attenation in the area surrounding the installation of components of the sound having frequencies in the range 20–50 Hz; effective suppression of the higher frequency components was already provided for by means of a conventional passive silencer, but this left a "rumble" in the lowest audible octave which was capable of causing annoyance by virtue of its audibility under certain weather conditions at distances up to one kilometer from the installation. The passive silencer is in the form of a vertically extending duct of diameter 3.25 meters through which the exhaust gases pass to emerge at the upper end, which is situated approximately 12 meters above ground level; the duct is lined with sound absorptive material, and a further mass of this material is situated centrally within the duct extending over a length of about five meters adjacent the upper end.

Figure 4:
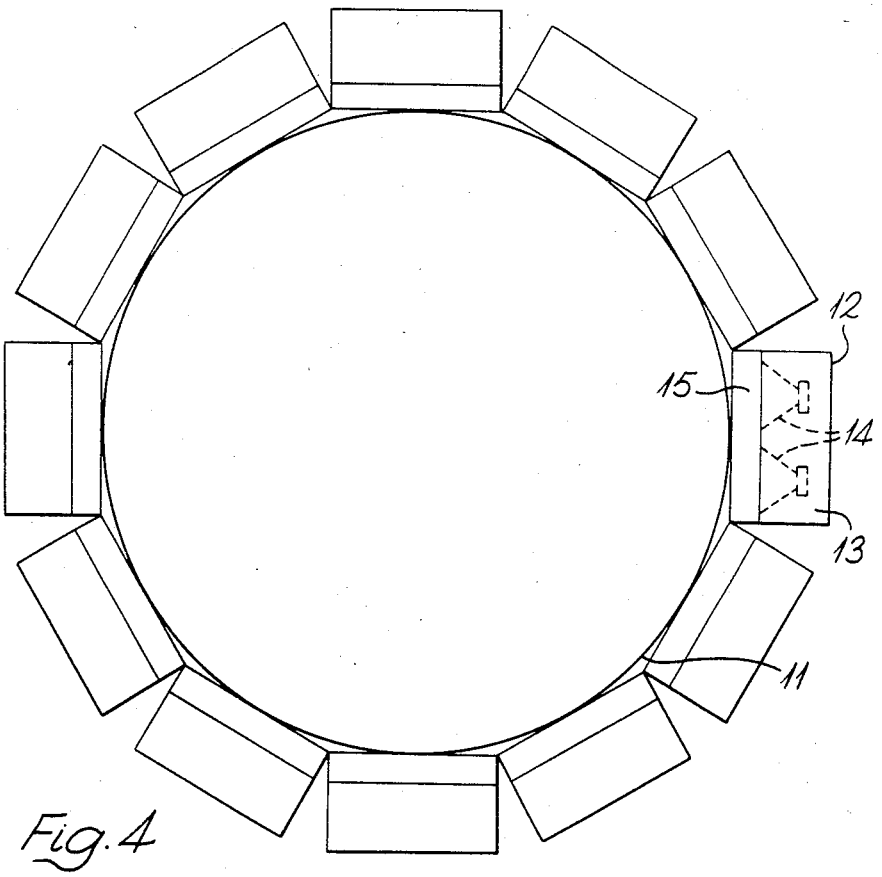
FIGS. 4 and 5 are diagrams illustrating the layout of the transducers of one active sound control system according to the invention.

In order to generate a cancelling sound wave of sufficient power, the active sound control system includes a sound generating system incorporating 72 moving coil loudspeakers having conical diaphragms of diameter 38 cm, which are mounted in groups of six in a series of 12 identical cabinets arranged in a circular array around the upper end of the passive silencer. The layout of the system is illustrated in the diagrammatic plan and vertical sectional views respectively shown in FIGS. 4 and 5, in which only the outline of the silencer duct 11 is indicated for the sake of simplicity. Each cabinet 12 is formed so as to provide a rectangular chamber 13 within which the six loudspeakers 14 of the relevant group are mounted, and a vertically extending duct 15 of rectangular cross-section which is closed at its lower end and open at its upper end, the chamber 13 and duct 15 having a common wall 16; the six loudspeakers 14 are disposed in the chamber 13 in two side-by-side vertical columns (as indicated in FIG. 4 for one only of the cabinets 12), with their diaphragms respectively in register with six ports formed in the wall 16 so that they radiate into the duct 15. In order to achieve the smallest practicable effective diameter for the sound source constituted by the loudspeaker array, the cabinets 12 are disposed with the ducts 15 nearer the silencer duct 11 than the chambers 13.

Figure 5:
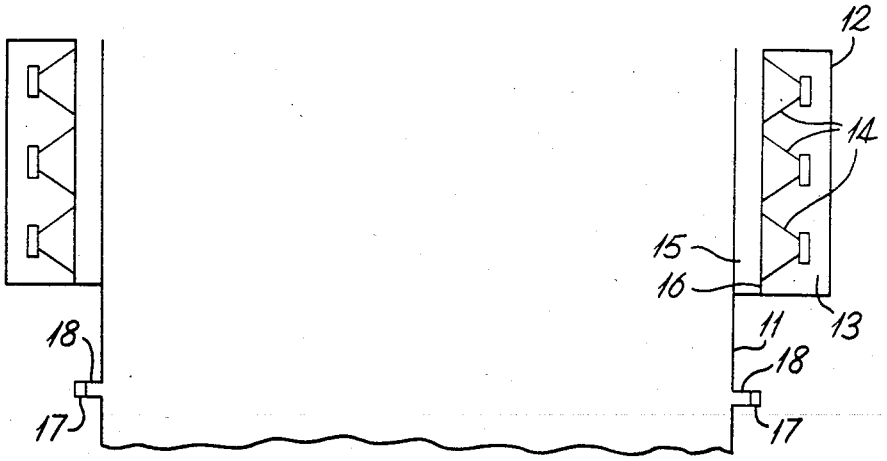

The sound control system also includes a sound detection system incorporating a pair of condenser microphones arranged to be responsive to the sound which is to be attenuated. As shown in FIG. 5, the microphones 17 are disposed at the ends of short stub pipes 18 which communicate with the interior of the silencer duct 11 and are disposed diametrically opposite each other at a level about 1.8 meters below the upper end of the duct 11. It will be appreciated that the microphones 17 are also responsive to the sound generated by the loudspeaker array. A further microphone (not shown) may be situated outside the duct exit.

Figure 6:
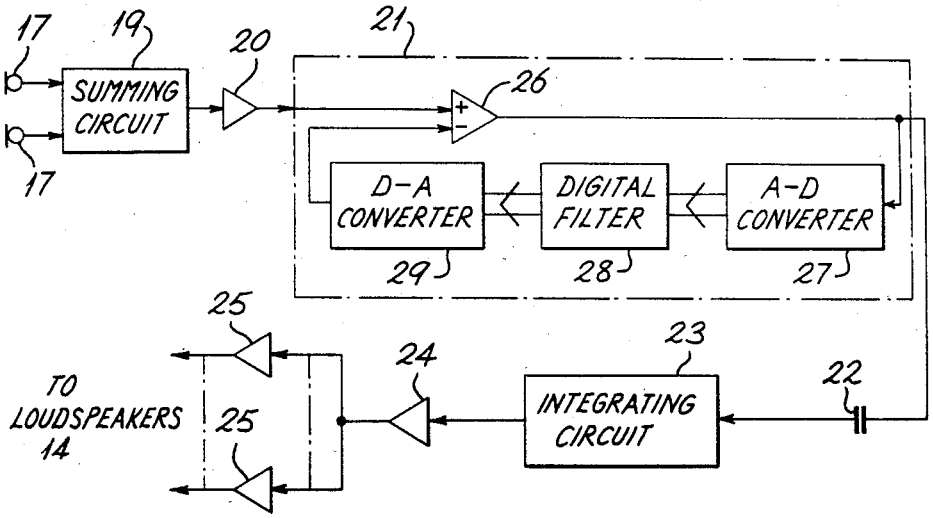
FIG. 6 is a diagram illustrating the arrangement of the electrical components of that system.

The overall electrical arrangement of the sound control system is illustrated by the schematic diagram in FIG. 6. As indicated therein, the outputs of the microphones 17 and the further microphone, when present, are combined in a summing circuit 19 to provide a signal which is fed via a buffer amplifier 20 to a signal processing system generally designated 21, which will be described in more detail below. The output of the system 21 is fed via a d.c. blocking capacitor 22, an integrating circuit 23 and a buffer amplifier 24 to the inputs, connected in parallel, of a series of 12 power amplifiers 25 to whose outputs the 12 groups of loudspeakers 14 are respectively connected; the amplifiers 25 may suitably have a peak power rating of one kilowatt each, and the coils of each group of loudspeakers 14 are connected in a suitable series-parallel combination to provide an appropriate load impedance for the corresponding amplifier 25. The integrating circuit 23, which may suitably have a time constant of one second, serves both to provide high frequency attenuation and to boost the low frequency gain so as partly to compensate for the low frequency characteristic of the loudspeakers 14, which falls off rapidly below their resonant frequency; thus the effect of the circuit 23 when combined with the natural frequency response characteristic of the loudspeakers 14 is to yield an overall bandpass characteristic. In analysing the system illustrated in FIG. 6, in particular for the purpose of comparison with the arrangement illustrated in FIG. 3, it is appropriate to treat the components 19 and 20 as forming part of the sound detection system together with the microphones 17, and to treat the components 22–25 as forming part of the sound generating system together with the loudspeakers 14.

The signal processing system 21 comprises a differential amplifier 26 of unity gain, the non-inverting input and output of the amplifier 26 respectively constituting the input and output of the system 21. The system 21 further comprises a negative feedback loop incorporating an analogue-to-digital converter 27 whose input is connected to the output of the amplifier 26, a digital filter 28 whose input is connected to the output of the converter 27, and a digital-to-analogue converter 29 whose input is connected to the output of the filter 28 and whose output is connected to the inverting input of the amplifier 26. The digital filter 28 may suitably be of a non-recursive type operating with a sampling frequency of 800 Hz and having an 8-bit input and a 12-bit output; such a filter having 93 coefficients may for example be constructed in accordance with well-known practice using a standard 8-bit microprocessor unit, an Erasable Programmable Read-Only Memory of capacity two kilobytes, and a Read-Write Memory of capacity one kilobyte.

The coefficients of the filter 28 are programmed, in accordance with the results of preliminary experiments such as are referred to above, so that the transfer function of the feedback loop approximates as closely as possible to the form $(D_s+1/F-1)$, where $D_s$ has the same significance as before (i.e. it represents the transfer function from the output to the input of the system 21 via the acoustic coupling between the sound generating system incorporating the loudspeakers 14 and the sound detection system incorporating the microphones 17) and F represents the transfer function of a notional band-pass filter having a pass band of 20–50 Hz, the value of F at any frequency within this range being equal to the value of $\overline{T}$ given by equation (7) in respect of a series of points situated at ground level and spaced at equal intervals on a circle of radius 100 meters centred on the vertical axis of the silencer 11. The preliminary experiments in this case of course involve analysis of signals derived from the sound detection system incorporating the microphones 17 (i.e. appearing at the output of the amplifier 20) and signals derived from further sound detection systems (not shown) respectively located at the series of points referred to. From this analysis there are obtained data which specify in the frequency domain the desired form ($T_D$) of the transfer function of the feedback loop. An appropriate computational procedure utilising these data is then carried out in order to derive appropriate values for the coefficients of the filter 28. This procedure is akin to the well-known technique referred to in the art as "system identification", but differs in approach because the desired transfer function $T_D$ is explicitly defined. In standard system identification methods, it is usual for the basic data to be constituted by an input time series and an output time series, from which autocorrelation and cross-correlation functions are determined; these are used to calculate a correlation matrix which is in turn inverted in order to derive the digital filter coefficients, In the present case, however, the procedure adopted involves specifying an appropriate input signal spectrum and calculating therefrom the corresponding output signal spectrum and input-output cross-spectrum for a system having a transfer function of the form $T_D$; the three spectra are then transformed to generate autocorrelation and cross-correlation data which are used in the derivation of the digital filter coefficients in the same way as in standard system identification. The input signal spectrum may suitably be derived by measurement of the output of the amplifier 20 obtained with the gas turbine running but with no excitation of the sound generating system incorporating the loudspeakers 14; in some cases the measured spectrum may be used as it stands, but in others it may be appropriate to weight the measured spectrum so as to take account of specific design requirements, for example by emphasising that portion of the spectrum in the frequency range over which optimum silencing performance is required.

In use of a system as described with reference to FIGS. 4 to 6, it has been found possible to achieve an attenuation of the order of 10 dB for the unwanted sound over the whole of the relevant frequency range.

In the foregoing description with reference to the drawings, it is assumed that the design of the sound control system can be treated on a permanent basis, so that the setting up of the signal processing system to achieve a desired transfer function is a once for all operation. It should be appreciated, however, that the invention is also applicable to sound control systems of the adaptive type, in which provision is made for adjusting the signal processing system so as to take account of temporal changes in the factors which determine the desired form of its transfer function.

I claim:

1. An active sound control system comprising a sound detection system arranged to be responsive to an unwanted sound wave which it is desired to attenuate, a sound generating system which couples acoustically with the detection system, and control means for operating the generating system in response to a signal derived from the detection system so as to generate a cancelling sound wave which interferes destructively with the unwanted wave in a selected spatial region, wherein the control means incorporates a signal processing system via which the signal derived from the detection system is fed to the generating system, the signal processing system comprising a forward signal-translating component having a gain factor which is of constant value G at least over a given frequency range and a negative feedback loop having a transfer function substantially of the form $(D_s+1F/-1/G)$, wherein $D_s$ represents the transfer function from the output to the input of the signal processing system via said acoustic coupling, and F represents a transfer function the characteristics of which match those of a notional bandpass filter first having a pass band over the given frequency range, and secondly would substantially supress unwanted sound independently, if said acoustic coupling did not exist, in the selected region over the given frequency range.

2. A system according to claim 1 wherein F approximates, over the pass band, to $-P_n/P_sD_n$ where $P_n$ represents the transfer function between the source of the unwanted sound wave and a point in the said region, $P_s$ represents the transfer function between the sound generating system and the said point, and $D_n$ represents the transfer function between the said source and the input to the signal processing system.

3. A system according to claim 1 wherein F approximates, over the pass band, to a transfer function derived from individual transfer functions $T_r$, where $T_r$ is determined by $-P_{nr}/P_{sr}D_n$, $P_{nr}$ transfer function between the source of the unwanted sound wave and the $r^{th}$ of r points in the said region, $P_{sr}$ represents the transfer function between the sound generating system and the $r^{th}$ point, $D_n$ represents the transfer function between the said source and the input to the signal processing system.

4. A system according to claim 3 wherein F approximates, over the pass band, to $\Sigma 1/T_r^*/\Sigma 1/T_rT_r^*$ where $T_r^*$ denotes the complex conjugate of $T_r$.

5. A system according to claim 3, for attenuating unwanted sound waves from a duct, wherein the sound generating system comprises a plurality of arrays of sound sources distributed around the perimeter of that end of a duct from which unwanted sound waves emanate.

6. A system according to claim 5 wherein the sound generating system comprises a d.c. blocking capacitor at the output of the signal processing system, an integrating circuit with input coupled to the capacitor and a plurality of amplifying means, one for each array of sound sources coupled between the output of the integrating circuit and that array.

7. A system according to claim 5 wherein each array comprises a housing defining a sound channel having an opening immediately adjacent to, but outside, the duct and a plurality of sound sources which direct sound into the sound channel.

8. A system according to claim 5, wherein the sound detection system comprises a plurality of microphones inside the duct, and means for summing the outputs of the microphones.

9. A system according to claim 8 including a further microphone just outside the said end of the duct.

10. A system according to claim 1 wherein the feedback loop comprises an analogue-to-digital converter with output connected to a digital filter, the filter output being connected to the input of a digital-to-analogue converter.

11. A system according to claim 5 wherein the said end of the duct is located substantially above the ground surface and the r points are spaced around a circle centered on the duct, the circle being larger than the duct cross section.

* * * * *